United States Patent [19]

Chia-Liu

[11] 4,191,354

[45] Mar. 4, 1980

[54] READING RACK FOR LYING POSITION

[76] Inventor: Su Chia-Liu, 29-1 Yuan Ben, 8th Lin, Yuan Ben Li, Young mei, Tao-Yoan Hsien, Taiwan

[21] Appl. No.: 943,799

[22] Filed: Sep. 19, 1978

[51] Int. Cl.[2] ..... A47B 23/00

[52] U.S. Cl. ..... 248/445; 248/451

[58] Field of Search ..... 248/102, 104, 105, 106, 248/107, 451, 452, 453, 462, 445; 211/42, 43

[56] References Cited

U.S. PATENT DOCUMENTS

| | | | |
|---|---|---|---|
| 431,036 | 7/1890 | Dawson | 248/454 |
| 747,973 | 12/1903 | Ives | 248/107 |
| 916,901 | 3/1909 | Trimble | 248/452 |
| 1,627,350 | 5/1927 | Steinman | 248/451 |
| 2,136,701 | 11/1938 | Manierre | 248/445 |
| 2,909,345 | 10/1959 | Matsuoka | 248/106 |
| 3,905,573 | 9/1975 | Davis | 248/445 |

FOREIGN PATENT DOCUMENTS

| | | | |
|---|---|---|---|
| 1518012 | 2/1968 | France | 248/445 |

*Primary Examiner*—William H. Schultz
*Attorney, Agent, or Firm*—Holman & Stern

[57] ABSTRACT

A reading rack for reading in a lying position, comprises a lamp stand, detachable book shelf, pen rack, folding legs, flexible metal arm, adjustable rod, folding arms, and clamps. The illuminating lamp is fixed on the lamp stand through a flexible metal arm, and the direction of the illuminating lamp can be adjusted to fit a reader's position. The detachable book shelf is attached on the rear of lamp stand by a sleeve ring. The flexible metal arm is fixed on a link rod, and can be freely bent; in addition, with the assistance of the adjustable rod, and clamps, the device can hold books or newspapers of different sizes.

6 Claims, 3 Drawing Figures

READING RACK FOR LYING POSITION

BRIEF SUMMARY OF THE INVENTION

This invention provides a reading rack for a reader in a lying position; and includes a detachable book shelf and a pen rack for books and pens respectively. An illuminating lamp is fixed on the lamp stand through a flexible metal arm; therefore, the lamp can be positioned in any angle to suit the reader. An adjustable rod that is fixed on the lamp stand through a flexible metal arm can fasten, with the assistance of clamps, various kinds of books or newspapers of substantially any size.

DETAILED DESCRIPTION

Figure 1:
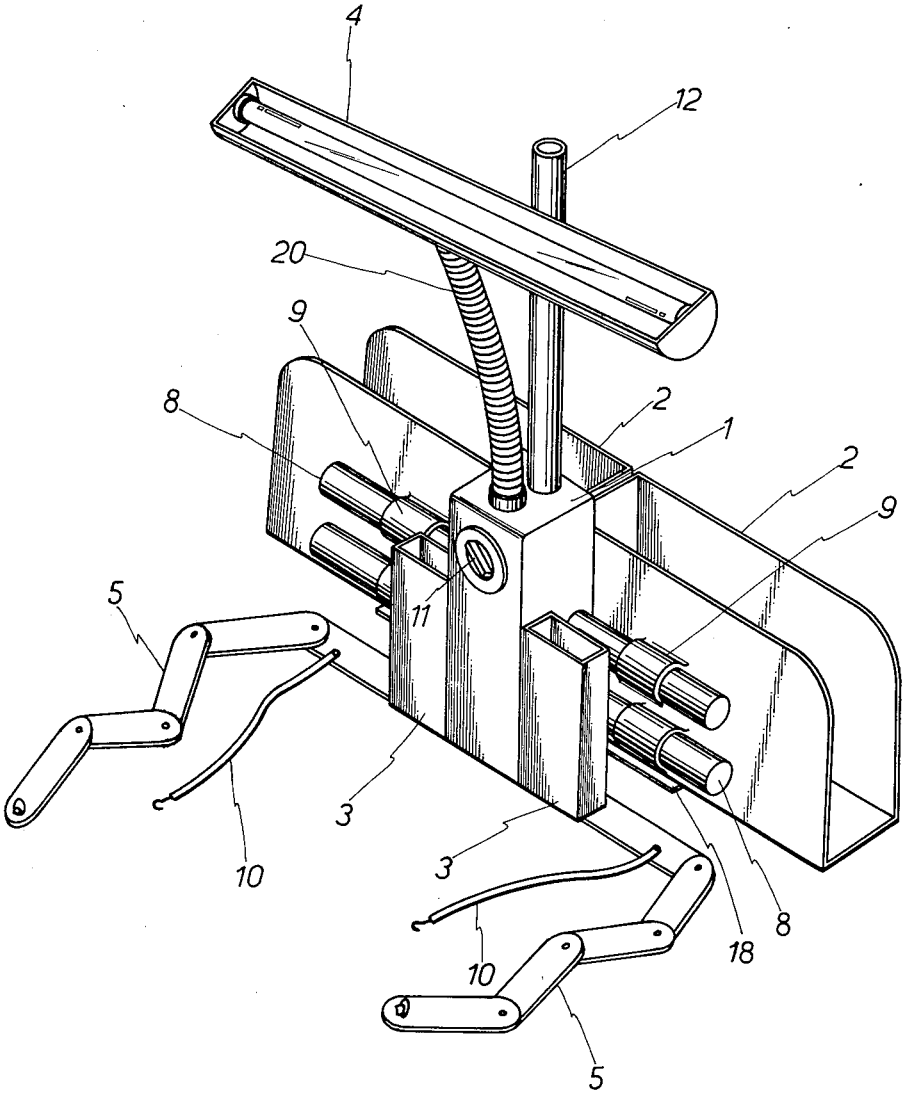
FIG. 1 is a perspective view of lamp stand for a reading rack.
Figure 2:
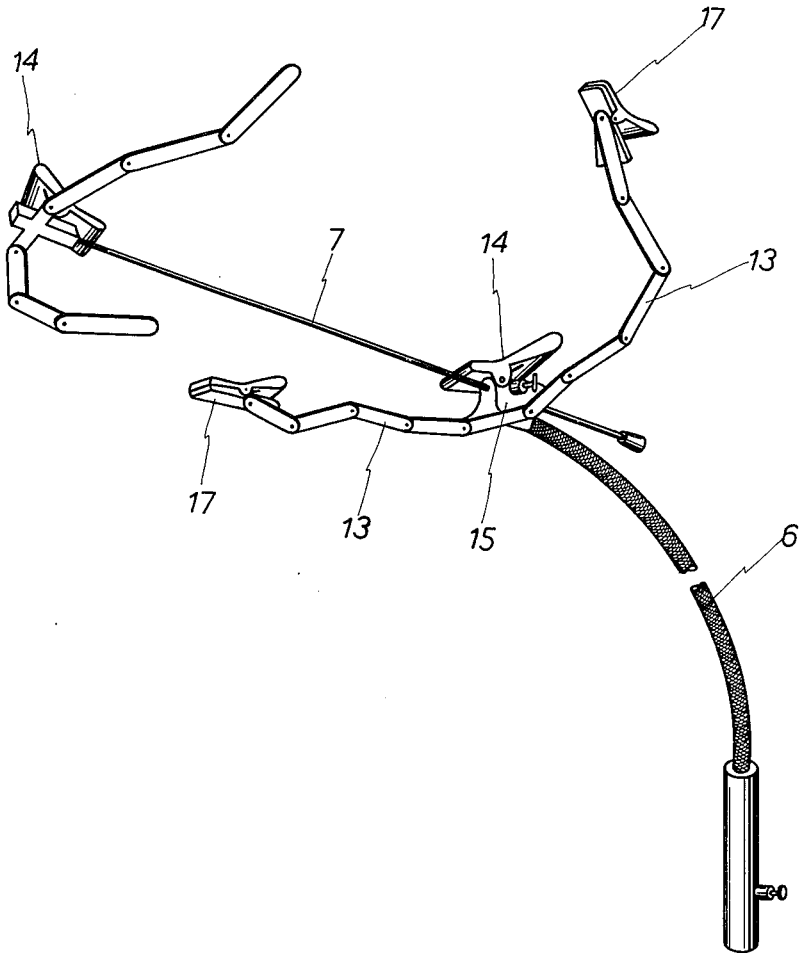
FIG. 2 is a perspective view of an extension rod and flexible metal arm.

The illustrated reading rack comprises a lamp stand (1), detachable book shelf (2), pen rack (3), illuminating lamp (4), folding leg (5), flexible metal arm (6), and adjustable rod and on each side of said lamp stand (1), there is a rod (8) to accomodate a sleeve ring (9) of said detachable book shelf (2). Each side of lamp stand (1) is provided with pen racks (3) for holding pens and pencils or the like. Under the pen racks (3), two folding legs (5) and two elastic belts (10) are installed, and each of the said legs and belts extends from either side of said pen racks (3); by the said legs (5) and belts (10). The rack can be fixedly attached beside a pillow (19) and whenever a person lies on the pillow (19), the weight of his (Or her) head will make the rack more stable and balanceable in its position. In case of not using it, the folding legs (5) can be folded into a partition strip (18) which is under the detachable book shelf (2).

Figure 3:
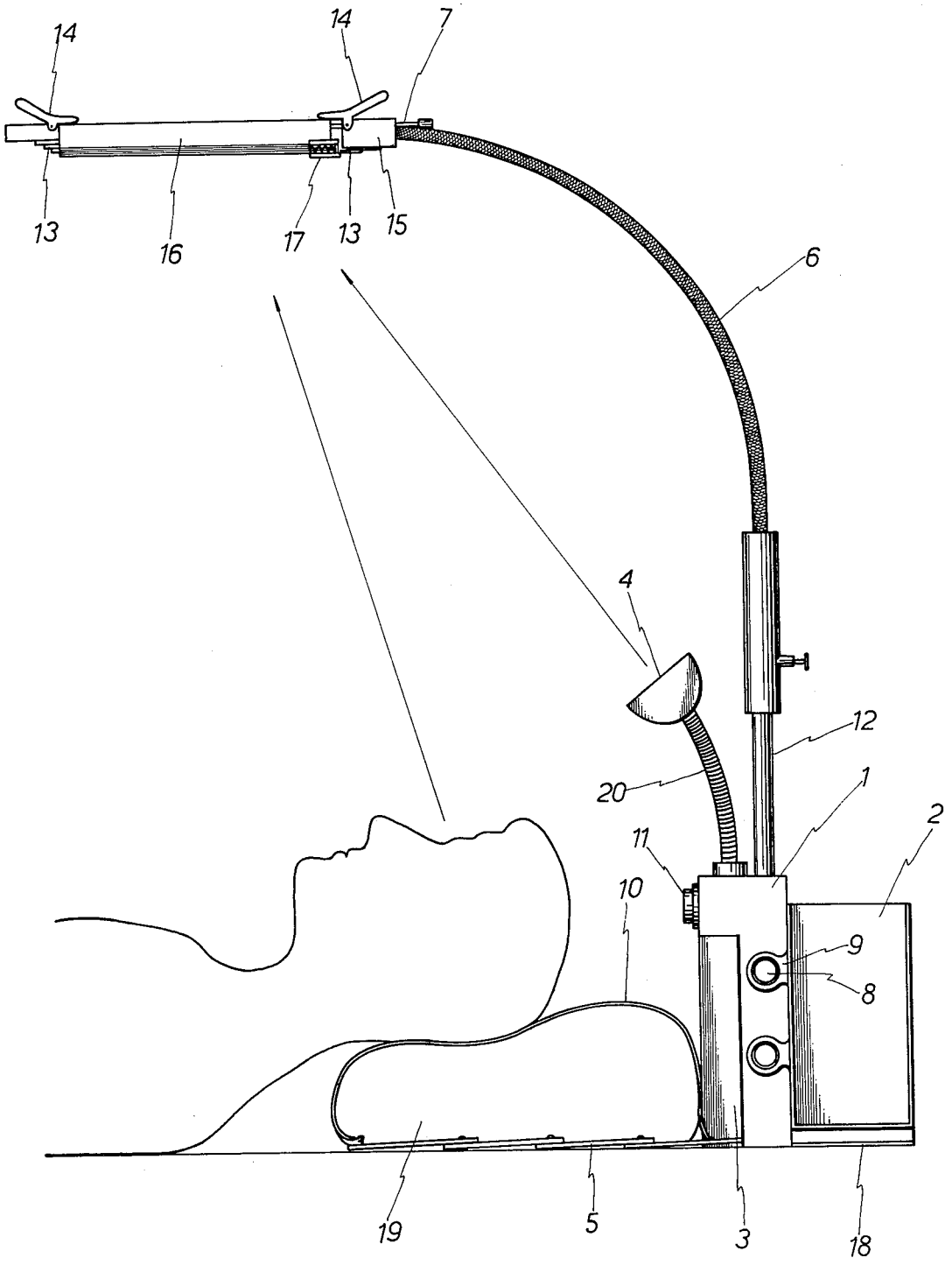
FIG. 3 is a side view of the stand of FIG. 1 and the arm of FIG. 2 in an assembled condition.

On the front of lamp stand (1), there is a switch (11) which can be used for adjusting the power of illuminating lamp (4). On the top of lamp stand (1), there is a link rod (12) which is used for attaching the flexible metal arm (6) as shown in FIG. 3. On the tip of said flexible metal arm (6), two folding articulated arms (13) are provided to extend in opposite directions; and on the tip of each of said folding arms, there is a clamp (17). In addition, on the tip of the flexible metal arm (6), there is a bearing block or rod seat (15) which is used for fixing an adjustable rod (7) . On the rod seat (15), there is another clamp (14). A book or newspaper can be put on the adjustable rod (7) and can be fastened by clamp (14) and is ready for reading by a person who is in lying position.

FIG. 3 shows the practical use of this invention fixed on one side of pillow (19) by folding legs (5) and elastic belts (10). The illuminating lamp (4) is now hanging over the reader's head, and the illuminating angle may be adjusted by moving the flexible metal arm (20). In addition, the flexible metal arm (6) can also be adjustable, and with the help of two clamps (17) on folding arms (13) to fasten the book or newspaper, the reader can make his (or her) comfortable reading in any position that he may desire (in supine or lateral position); in other words, this invention can have one's visual line perpendicular to the surface of an object being read.

I claim:

1. A stand for reading material comprising a base member, a flexible arm extending upwardly from said base member, and a support assembly extending from a free end of said arm, said assembly including a bearing block mounted to the free end of said arm, a support rod axially adjustably mounted in said bearing block, a first pair of foldable articulated arms extending laterally from said bearing block on opposite sides of the rod axis respectively clamping means on said bearing block and at a free end of said rod remote from said bearing block and a second pair of foldable articulated arms extending laterally from said free end of said rod on opposite sides of the rod axis respectively.

2. The stand of claim 1 including a clamp at the free end of each of said first pair of foldable articulated arms.

3. The stand of claim 1 including releasable attachment means between said flexible arm and said base member.

4. The stand of claim 1 wherein said base member includes a lamp fitting and means for adjusting the position of said lamp fitting.

5. The fitting of claim 1 wherein said base member includes removable book shelf means.

6. The fitting of claim 1 wherein said base member includes attachment means comprising an articulated linkage pivoted to said base member, an elastic cord attached to said base member and mutually interengageable means at the free ends of said linkage and said cord respectively.

* * * * *